US005667648A

United States Patent [19]

McDonald

[11] Patent Number: 5,667,648

[45] Date of Patent: Sep. 16, 1997

[54] REMOVABLE CLOSURE FOR AN OPENING IN AN ALUMINUM REFINING POT

[75] Inventor: James Barrett McDonald, St. Albans, W. Va.

[73] Assignees: Michael J. McDonald; Ben N. McDonald

[21] Appl. No.: 617,155

[22] Filed: Mar. 18, 1996

[51] Int. Cl.[6] ..... C25C 3/08; C25C 7/00; A47H 1/00; A47H 7/00

[52] U.S. Cl. ..... 204/245; 204/279; 160/349.1; 160/350

[58] Field of Search ..... 204/245–247, 204/279; 160/349.1, 350

[56] References Cited

U.S. PATENT DOCUMENTS

| | | | |
|---|---|---|---|
| 2,608,250 | 8/1952 | Meyer | 160/349.1 X |
| 3,808,610 | 5/1974 | Mortensen | 160/349.1 X |
| 4,002,551 | 1/1977 | DuClaux et al. | 204/245 X |
| 4,136,003 | 1/1979 | Arnason et al. | 204/247 |
| 4,874,028 | 10/1989 | Lynch et al. | 160/349.1 X |
| 5,128,012 | 7/1992 | Olsen | 204/245 |

*Primary Examiner*—Donald R. Valentine
*Attorney, Agent, or Firm*—H. Jay Spiegel

[57] ABSTRACT

A closure is made of a flexible fabric material designed to withstand a temperature in the range of 1800° F. as is present within a pot employed to conduct the Hall-Heroult process for deriving aluminum from alumina. The closure, in a preferred embodiment, includes an elongated hook allowing it to be hung over the opening of the pot and also includes a gripping handle allowing the closure to be manipulated. A peripheral bulbous seal enhances the sealing effect about the opening in the pot.

15 Claims, 2 Drawing Sheets

REMOVABLE CLOSURE FOR AN OPENING IN AN ALUMINUM REFINING POT

BACKGROUND OF THE INVENTION

The Hall-Heroult process for deriving aluminum from alumina is well known. Customarily, a cell or pot (hereinafter referred to as a "pot") includes a chamber that is filled with molten cryolite maintained at a temperature of about 1800° F. Direct electrical current is passed through the cryolite from suspended carbon anodes to cathodes in the carbon lining of the cell or pot and into the collector bars or plates that are embedded in the bottom of the carbon lining. Energy from the electricity causes a crust to form over the top of the molten cryolite. Alumina is then added to the crust from supply bins above the cells and the electric current which passes through the crust drives off the oxygen atoms in the alumina leaving aluminum atoms in a molten state.

During the process, a chimney or other vent vents hot gasses formed during the process from the pot. The pot has an opening at the front end thereof which is used to siphon off molten aluminum periodically during the conducting of the process. This opening is devoid of any closure and when hot gasses are vented from the pot through the chimney, this action causes air from the room in which the pot is located to be sucked into the internal chamber of the pot. Such airflow reduces the temperature within the pot and requires the expenditure of energy to maintain the temperature of the pot at the desired temperature of about 1800° F. If a closure could be provided to close this opening during conducting of the process but which closure could be easily removed to permit siphoning of molten aluminum from the cell chamber, the efficiency of the process could be enhanced. It is with this thought in mind that the present invention was developed.

The following prior art is known to Applicant:

U.S. Pat. No. 2,043,700 to Hamm

U.S. Pat. No. 2,686,747 to Wurtz et al.

U.S. Pat. No. 2,716,788 to Naramore

U.S. Pat. No. 5,001,865 to Procton

U.S. Pat. No. 5,470,445 to Murray et al.

The present invention patentably distinguishes from the teachings of these patents, taken alone or in combination, as contemplating a removable closure for the opening in an aluminum refining pot that includes a flexible heat-resistant material having a peripheral sealing bead.

SUMMARY OF THE INVENTION

The present invention relates to a removable closure for an opening in an aluminum refining pot. The present invention includes the following interrelated objects, aspects and features:

(1) In a first aspect, the inventive closure is intended to be used to cover an opening in an aluminum refining pot of the type used to conduct the Hall-Heroult process which is employed to derive aluminum from alumina. Such a device includes an opening employed to siphon molten aluminum off from a chamber of the pot.

(2) The inventive closure is designed to be removably attachable over the opening of the pot to seal the opening and increase the efficiency of the pot.

(3) The inventive closure is preferably made of a flexible fabric of a material that can withstand the high temperature, in the range of 1800° F., within the chamber of the pot. The closure has a peripheral seal in the form of an enlarged bulbous bead that best facilitates sealing about the opening of the chamber.

(4) In one preferred embodiment, at an upper portion of the closure, a hook-like appendage is formed facilitating hanging of the closure on an upstanding lip of the pot. Of course, other means of attachment may be suitably employed.

(5) In a further aspect, in the preferred embodiment, a handle is provided on the closure allowing the user to grasp the closure and easily remove it from the opening to allow siphoning of molten aluminum from the chamber.

As such, it is a first object of the present invention to provide a removable closure for an opening in an aluminum refining pot.

It is a further object of the present invention to provide such a device wherein the closure is made of a flexible fabric of a material that can withstand the high temperatures in the chamber of the pot.

It is a still further object of the present invention to provide such a device including means for removably affixing it over the opening of the pot chamber.

These and other objects, aspects and features of the present invention will be better understood from the following detailed description of the preferred embodiment when read in conjunction with the appended drawing figures.

SPECIFIC DESCRIPTION OF THE PREFERRED EMBODIMENT

Figure 2:
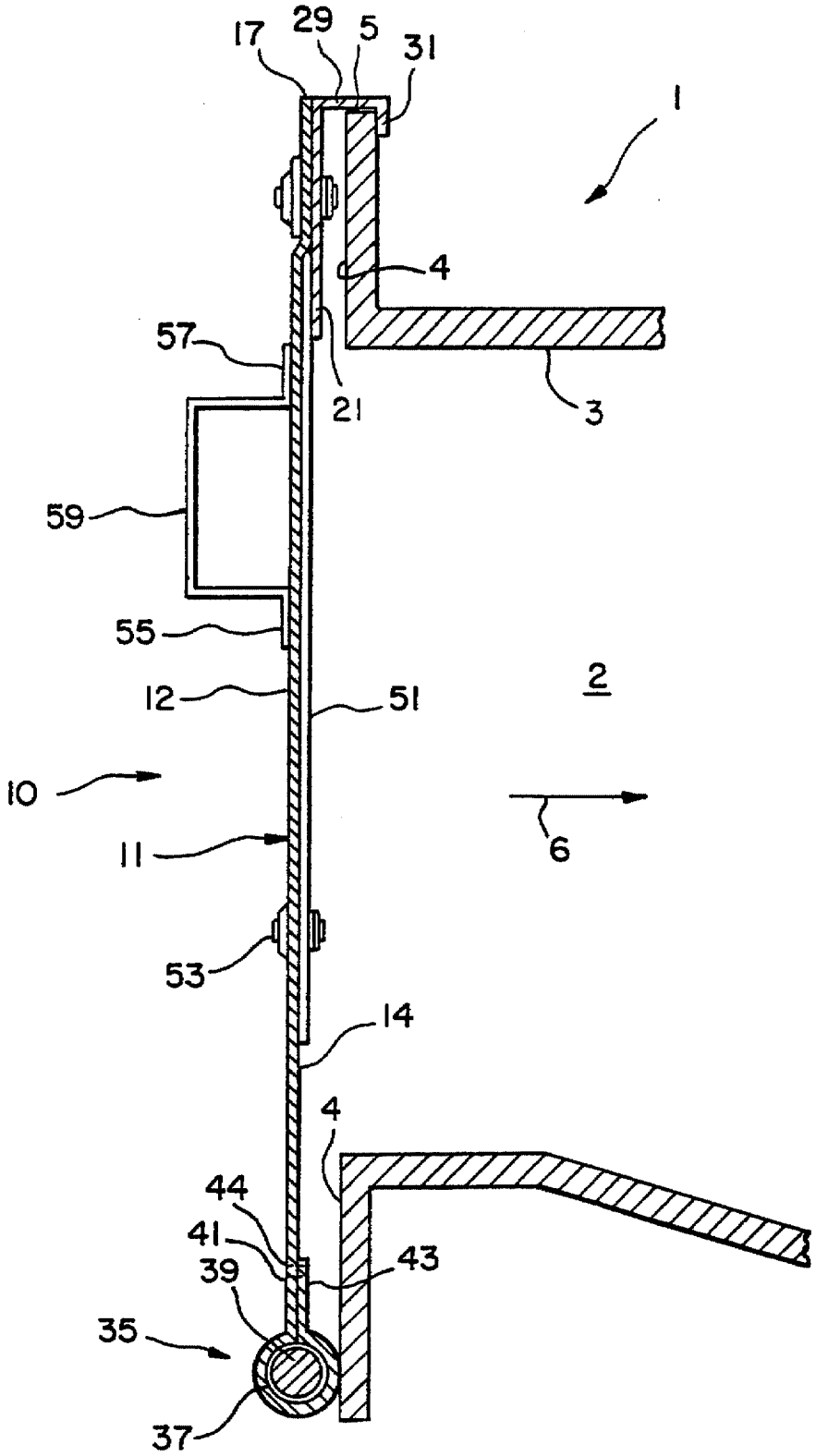
FIG. 2 shows a cross-sectional view along the line II—II of FIG. 1.

With reference, first, to FIG. 2, a pot used for conducting the Hall-Heroult process employed to distill aluminum from alumina is generally designated by the reference numeral 1 and only the portion pertinent to the present invention is shown. In particular, the pot 1 has a chamber 2 that has a generally rectangular opening 3 designed to be employed to siphon molten aluminum from the chamber 2 periodically during conducting of the Hall-Heroult process. As seen in FIG. 2, the opening 3 has a peripheral surface 4 that extends circumferentially about the opening 3. The surface 4 has an upper termination 5 as shown.

Figure 1:
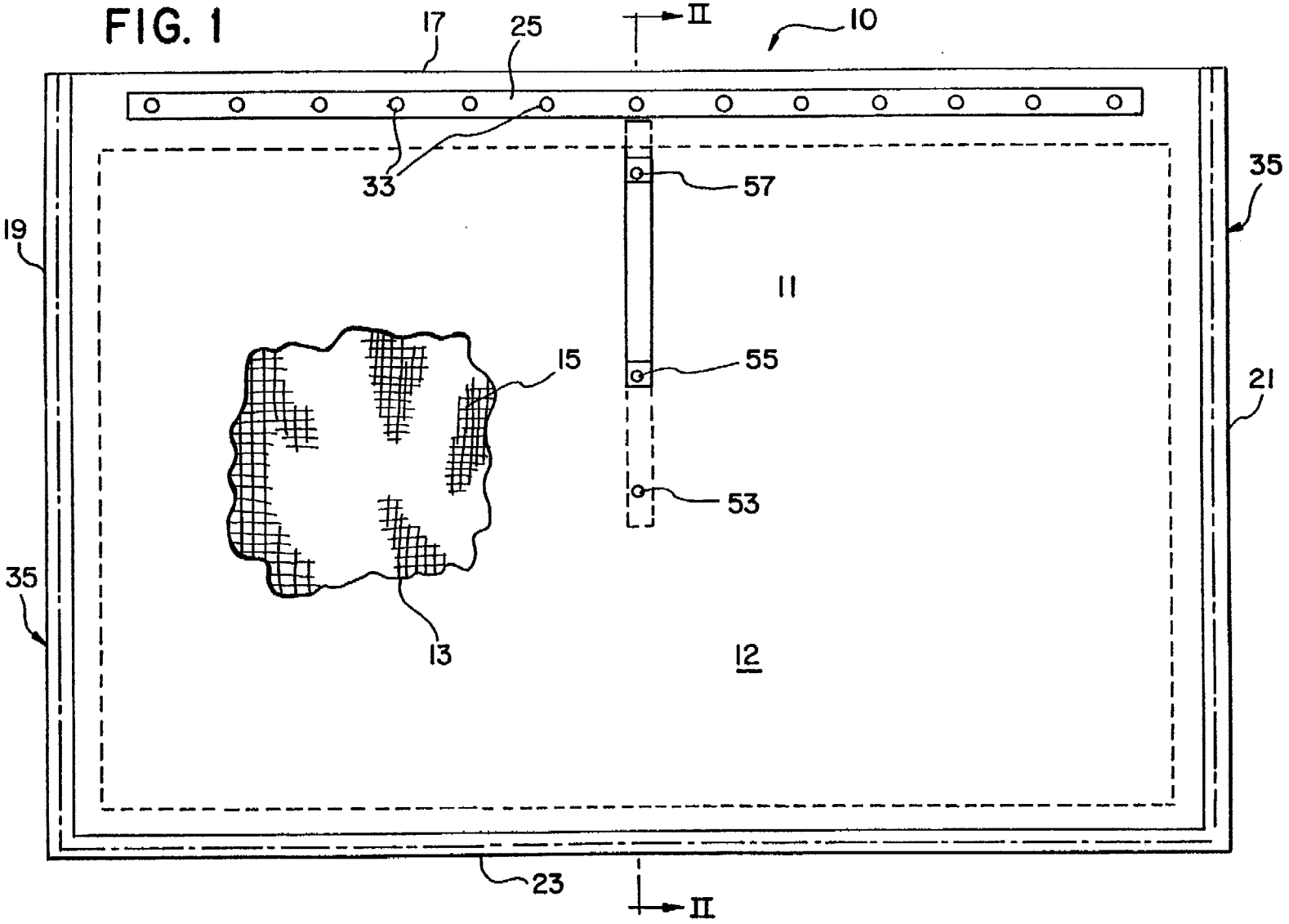
FIG. 1 shows a front view of the present invention.

Now, with reference to FIGS. 1 and 2, the inventive closure is generally designated by the reference numeral 10 and is seen to include a generally rectangular body 11 made up of a material such as a flexible fabric. The reference numeral 13 depicts a small portion of the surface 12 of the body 11 enlarged to show the details of the weaving 15 of the fabric forming the body 11. In the preferred embodiment of the present invention, the fabric used to form the body 11 may consist of a mixture of fiberglass and KEVLAR designed to be able to withstand the temperature within the chamber 2 of the pot 1, namely, a temperature in the range of 1800° F. Ceramic materials may also be employed in the fabric forming the body 11. One example of a material which has been found useful in making the body 11 comprises NOVATEX textile material, a mixture of fiberglass and KEVLAR. Such material is available from the NOVA RUBBER COMPANY, INC. of South Charleston, W. Va. Applicant has found that the NOVATEX fabric is ideal for many applications including welding curtains, stress relief blankets, fire curtains, brazing separators, furnace curtains, high temperature packing/sealing and energy saving thermal insulation.

The body 11 has a top edge 17 as well as side edges 19 and 21 and a bottom edge 23. As seen in the figures, the body 11 adjacent the top edge 17 is clamped between an elongated, preferably metallic, strip 25 and, with reference to FIG. 2, attachment means comprising an elongated hook body 27 having an upper hook-like appendage 29 including a downwardly depending termination 31. As seen in FIG. 2, the downwardly depending termination 31 extends over the upper termination 5 of the peripheral surface 4 of the pot 1 to hold the closure 10 in place. A series of spaced fasteners 33 fasten the strip 25 to the side edge 21.

Adjacent the edges 19, 23 and 21, a peripheral seal 35 is formed. As best seen in FIG. 2, the seal 35 consists of a portion 37 of the fabric of the body 11 folded upon itself to enclose a seal member 39 of generally circular cross-section to form a bulbous seal about the periphery of the body 11. The seal member 39 may be made of any suitable material able to withstand the heat to which it is exposed from the chamber 2. In the preferred embodiment, the seal member 39 is made of a twisted fiberglass rope. The portions 41 and 43 of the body 11 are fastened together to enclose the fiberglass rope seal 39 through the use of appropriate stitching 44.

In a further aspect, the inventive device 10 includes a vertical metallic bar 51 that is clamped to the rear surface 14 of the body 11 by virtue of fasteners 53, 55 and 57. As best seen in FIG. 2, the front surface 12 of the body 11 has a handle 59 that is fastened to the bar 51 via the fasteners 55 and 57.

With the present invention having been described in detail, the mode of operation will now be explained. In particular, as explained above, the pot 1 has a chimney (not shown) that conducts hot fumes away from the chamber 2. This convection causes an airflow in the direction of the arrow 6 in FIG. 2 and, with the opening 3 of the pot 1 uncovered, air from the room in which the pot is located enters the chamber 2 via the opening 3 in the direction of the arrow 6. When the closure 10 is placed over the opening 3 in the manner best seen in FIG. 2, such airflow is stopped thereby (1) reducing convection of hot gasses out the chimney (not shown), and (2) thereby reducing the amount of energy required to maintain the temperature within the chamber 2 at the required level. The suction effect of air within the chamber 2 in the direction of arrow 6 holds the closure 10 against the surface 4.

When it is desired to siphon molten aluminum from the chamber 2, the handle 59 is grasped and the entire closure 10 is lifted off the upper termination 5 and is put aside, the molten aluminum is siphoned from the chamber 2 and then the closure 10 is replaced in the position best seen in FIG. 2 whereupon the process within the pot 1 continues.

Of course, if desired, any suitable means of attachment of the closure 10 over the opening 3 may be employed. Instead of the hook-like appendage 29, 31, the closure 10 could, if desired, be hingedly mounted on the surface 4. Additionally, a gate-like slatable mount could be provided to allow sliding movement across the opening 3. Again, any suitable means of attachment may be suitably employed.

Additionally, the handle 59 may be placed in any suitable location on the body 11.

Again, as explained above, the body 11 may be made of any suitable heat-resistant material such as combinations of KEVLAR, fiberglass and the like.

As such, an invention has been disclosed in terms of a preferred embodiment thereof which fulfills each and every one of the objects of the invention as set forth hereinabove and provides a new and useful removable closure for an opening in an aluminum refining pot of great novelty and utility.

Of course, various changes, modifications and alterations in the teachings of the present invention may be contemplated by those skilled in the art without departing from the intended spirit and scope thereof.

As such, it is intended that the present invention only be limited by the terms of the appended claims.

I claim:

1. In a pot for conducting a process for deriving aluminum from alumina, including a chamber having an access opening, the improvement comprising a closure for said opening including:

a) attachment means for attaching said closure over said opening;

b) said closure having a flexible body made of heat resistant fabric and sized to overlie said opening;

c) said body having a bulbous peripheral seal sealing about a periphery of said opening, said seal comprising a peripheral portion of said fabric folded upon itself and fastened together to form a pocket and a rope seal within said pocket.

2. The closure of claim 1, wherein said attachment means comprises a hook body at a top edge of said closure engageable over an upper termination of a surface peripheral to said opening.

3. The closure of claim 2, wherein said hook body is laterally elongated.

4. The closure of claim 1, wherein said fabric is woven.

5. The closure of claim 4, wherein said fabric includes fiberglass and can withstand a temperature of 1800° F. without deterioration.

6. The closure of claim 1, wherein said body is generally rectangular.

7. The closure of claim 1, wherein said rope seal is made of fiberglass.

8. A closure for an opening, comprising:

a) attachment means for attaching said closure over said opening comprising a laterally elongated hook body at a top edge of said closure engageable over an upper termination of a surface peripheral to said opening;

b) said closure having a flexible body made of heat resistant fabric and sized to overlie said opening;

c) said body having a peripheral seal sealing about a periphery of said opening.

9. The closure of claim 8, wherein said fabric is woven.

10. The closure of claim 9, wherein said fabric includes fiberglass and can withstand a temperature of 1800° F. without deterioration.

11. The closure of claim 8, wherein said body is generally rectangular.

12. The closure of claim 8, wherein said peripheral seal is bulbous.

13. The closure of claim 12, wherein said peripheral seal comprises a peripheral portion of said fabric folded upon itself and fastened together to form a pocket and a rope seal within said pocket.

14. The closure of claim 13, wherein said rope seal is made of fiberglass.

15. The closure of claim 8, further including a handle sized to be gripped to facilitate removal of said closure from an opening.

* * * * *